US006243160B1

(12) United States Patent
Takano

(10) Patent No.: US 6,243,160 B1
(45) Date of Patent: Jun. 5, 2001

(54) EXPOSURE DEVICE FOR A STRIP-LIKE WORKPIECE

(75) Inventor: Itaru Takano, Choufu (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/406,790

(22) Filed: Sep. 28, 1999

(30) Foreign Application Priority Data

Sep. 28, 1998 (JP) ..... 10-273343

(51) Int. Cl.[7] ..... G03B 27/32; G03B 27/62; G03B 27/52; G03D 17/00; G01N 21/86

(52) U.S. Cl. ..... 355/75; 355/27; 355/28; 355/40; 396/595; 396/598; 250/548

(58) Field of Search ..... 355/27, 28, 40, 355/75; 396/595, 598; 250/548

(56) References Cited

U.S. PATENT DOCUMENTS 4,136,946 * 1/1979 Nishimoto ..... 355/28
5,237,359 * 8/1993 Rosenberg et al. ..... 355/28
5,734,460 * 3/1998 Nakaoka et al. ..... 355/29
5,841,518 * 11/1998 Kajiwara ..... 355/40
5,892,571 * 4/1999 Yamamoto ..... 355/27

FOREIGN PATENT DOCUMENTS 3-19249 1/1991 (JP) .

* cited by examiner

*Primary Examiner*—Russell Adams
*Assistant Examiner*—Khaled Brown
(74) *Attorney, Agent, or Firm*—Nixon Peabody LLP; David S. Safran

(57) ABSTRACT

An exposure device in which a strip-like workpiece is transported by a grip feeding method, is to be able to expose the strip-like workpiece without being tensile stressed is achieved as follows: A feed grip part holds a strip-like workpiece. The workpiece is transported downstream in the transport direction. During transport of the workpiece, the serpentine of the workpiece is determined and corrected. After stopping the motion of the workpiece, it is attached by a workpiece holding device which is located upstream of an exposure part. Then, the feed gripper part is moved according to the amount of stretching of the workpiece upstream in the transport direction, while the workpiece remains clamped by the feed grip part. In this way, the tensile force exerted on the workpiece is eliminated. Next, the workpiece is attached by a second workpiece holding device. The workpiece is attached by suction by a workpiece carrier. The mask is moved, alignment is performed and the workpiece is exposed.

3 Claims, 9 Drawing Sheets

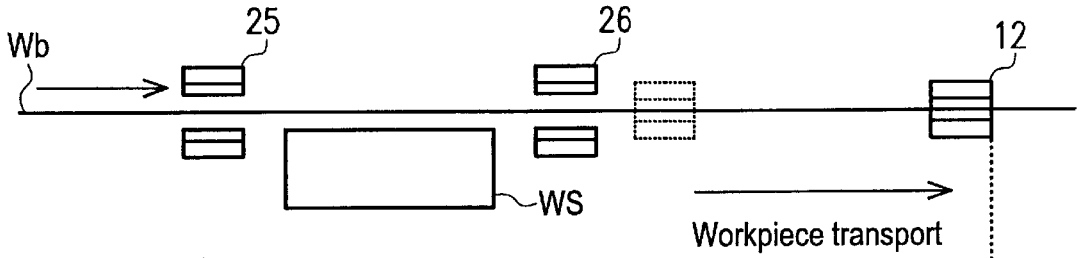
FIG.4(a) Holding and transporting the strip-like workpiece Wb by the feed grip part 12
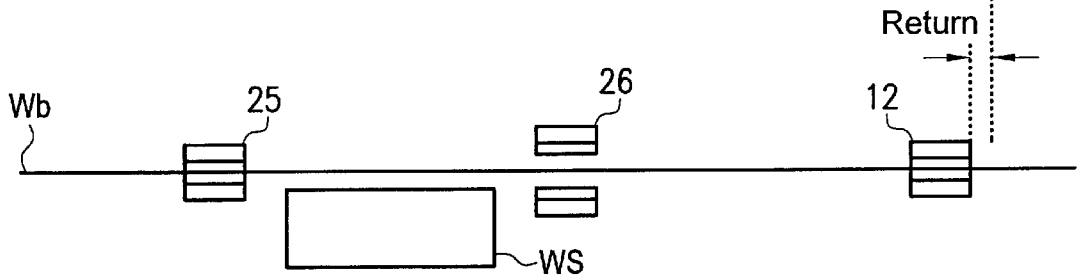
FIG.4(b) Attaching the strip-like workpiece Wb by the holding grip part 25, return of the feed grip part and reduction of the tensile force
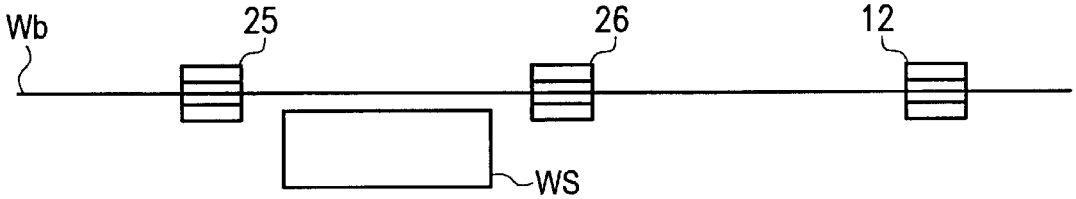
FIG.4(c) Attaching the strip-like workpiece Wb by the holding grip part 26
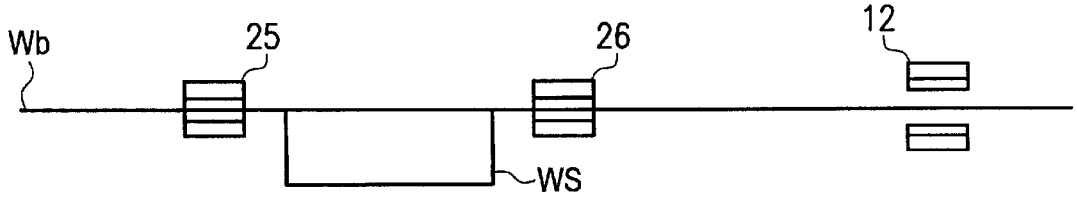
FIG.4(d) Release of holding the feed grip part 12 and lifting of the workpiece carrier

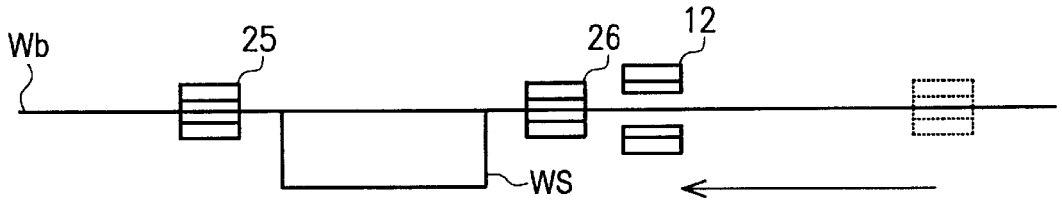
FIG.5(e) Alignment/exposure
(return to the zero point position of the feed grip part)
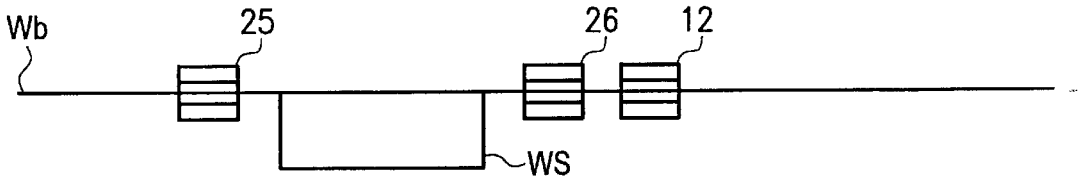
FIG.5(f) Alignment/exposure (attachment of the feed grip part 12)
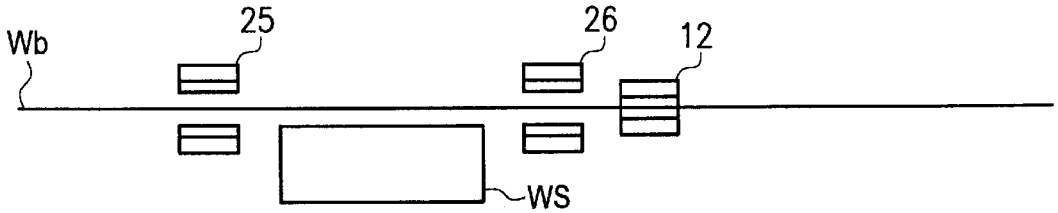
FIG.5(g) Release of the holding grip parts 25 and 26
and lowering of the workpiece carrier WS

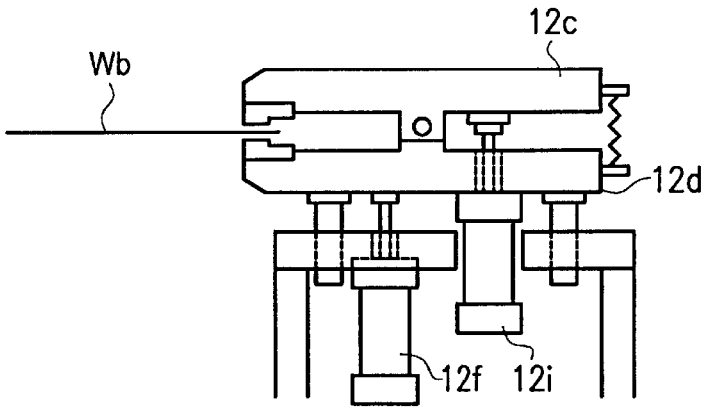
FIG.9(a) Initial position
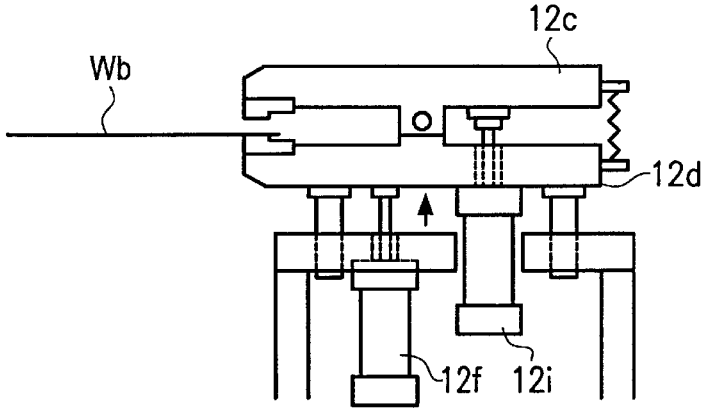
FIG.9(b) Movement of top component 12 [ill.] of the bottom component 12d by the pneumatic piston 12f upward (back of the strip-like workpiece Wb makes contact with the grip part Gr2 of the bottom component 12d
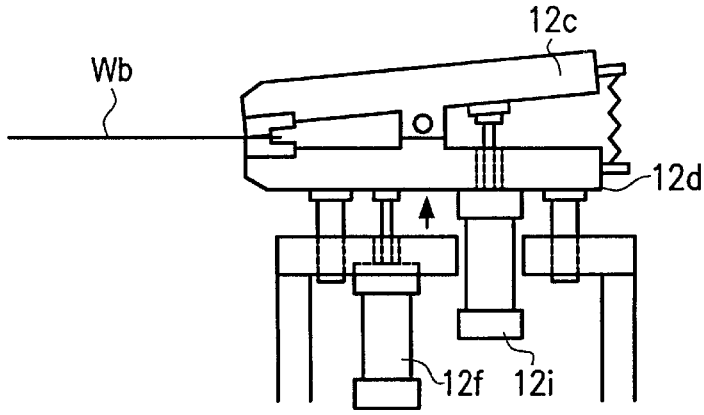
FIG.9(c) Rotation of the top component 12c by the pneumatic piston 12i (gripping of the strip-like workpiece Wb)

during exposure during release of the tensile force

EXPOSURE DEVICE FOR A STRIP-LIKE WORKPIECE

BACKGROUND OF THE INVENTION

1. Field of the Invention

The invention relates to a device for exposure of a continuous workpiece with a great length (hereinafter called a "strip-like workpiece"), such as a film of organic compound, lightweight metal, or the like. The invention relates especially to an exposure device for a strip-like workpiece which is used for exposure of a mask pattern onto a strip-like workpiece and for similar purposes.

2. Description of Related Art

Exposure of a strip-like workpiece, such as a film of organic compound, lightweight metal or the like is performed by the workpiece being unrolled from the rolled state, exposed and wound again onto a reel.

To transport the strip-like workpieces which are used for the above described exposure device, generally a tensile force is always applied to the workpiece between a takeoff reel and a take-up reel in order to ensure the stability and positioning accuracy of the workpiece during the workpiece transport and to correct bulging and waviness of the workpiece.

FIG. 6 is a schematic of a conventional example of the above described exposure device for a strip-like workpiece. In the figure, a takeoff reel part 10 is shown in which a takeoff reel 1, a spacer take-up reel 1*a* and a guide roller R1 are located. Furthermore, a strip-like workpiece Wb is conventionally located on a spacer S which is wound in the manner of a roll around the takeoff reel 1. When the strip-like workpiece Wb is unrolled from the takeoff reel 1, the spacer S is wound up by the spacer take-up reel 1*a*.

The strip-like workpiece Wb is relatively thick ($t \geqq 150$ microns, often $t=250$ microns). For example, a workpiece is used which was produced by a resin film being coated with a copper foil (conventionally thicker than the resin film). Therefore, there are strip-like workpieces Wb which have bulges in the direction of their width.

To transport a strip-like workpiece, for example, the process described in published Japanese Patent Application HEI 3-19249 is used in which the peripheral edge of the strip-like workpiece Wb is clamped using a grip feeding device described below, is pulled by a preset amount, and the strip-like workpiece Wb is transported by a predetermined amount (hereinafter this transport process is called a "grip feeding method").

The grip feeding method is effective when a strip-like workpiece which is thick and has a bulge in the direction of the width is transported without contact with the area to be exposed. In this method, the two edges of the workpiece are gripped and the workpiece is pulled in the fixed state. The workpiece therefore does not fall out of the transport means even if a workpiece with a bulge is transported at high speed.

The strip-like workpiece Wb which has been pulled off the takeoff reel 1 by a grip feeding device 11 is supplied to an exposure part 3 which has a workpiece carrier WS and the like, via the guide roller R1, an edge sensor S1 which determines the edge position of the strip-like workpiece, and a guide roller R2. If a predetermined area of the strip-like workpiece reaches the exposure part 3, transport of the strip-like workpiece Wb is stopped and the strip-like workpiece is exposed.

The strip-like workpiece Wb which is exposed in the exposure part 3 is wound up via guide rollers R3 and R4 by a take-up reel 2. When the strip-like workpiece Wb is wound up, a spacer 5 is supplied from a spacer takeoff reel 2*a* and the already exposed, strip-like workpiece Wb, together with the spacer S, is wound up by the take-up reel 2.

Here, it is desirable to always apply a tensile force to the strip-like workpiece Wb to prevent waviness and folds from forming in the strip-like workpiece Wb. Therefore, the takeoff reel 1 is always exposed to a force which is opposite to the transport direction of the strip-like workpiece Wb (in FIG. 6, to the right), so that, between the takeoff reel 1 and the take-up reel 2, the strip-like workpiece Wb is always exposed to a tensile force during its transport and also when stopped.

The take-up reel 2 is likewise always subjected to a force and turned in a direction in which the strip-like workpiece Wb is wound up. Between the takeoff reel 1 and the take-up reel 2, therefore, the strip-like workpiece Wb is always subjected to a tensile force.

In the above described exposure device for a strip-like workpiece, the strip-like workpiece Wb is transported in the manner described below, exposed and subjected to serpentine correction:

(1) Transport and Exposure of the Strip-like Workpiece Wb by the Grip Feeding Device The peripheral edge of the strip-like workpiece Wb is clamped by the grip feeding device and the strip-like workpiece Wb is transported by a stipulated amount. FIG. 7 shows an enlarged view of the grip feeding device which is shown in FIG. 6. As is shown in the drawings, the grip feeding device 11 has a feed grip part 12 which holds the edge of the strip-like workpiece Wb, and a feed grip drive part 13 which moves the feed grip part 12 by a predetermined amount.

The feed grip drive part 13, for example, has a ball-circulating spindle 13*b* which is turned by a feed motor 13*a* and a drive belt 13*c*, as is shown in the drawing. The motor 13*a* turns the ball-circulating spindle 13*b*, and the feed grip part 12 which engages the ball-circulating spindle 13*b* moves in the direction of the arrow in the representation. FIG. 8 is a schematic of the arrangement of a specific example of the above described grip feeding device 11, a workpiece carrier WS, which is viewed here from the transport direction, being shown in cross section, and the grip feeding device 11 also being shown. In the figure, a feed grip part 12 is shown only on one side, although on the other side there is also a feed grip part 12 with the same arrangement. The two edges of the strip-like workpiece Wb are held and the strip-like workpiece Wb is transported in this state. As is shown in the drawings, the feed grip part 12 engages the above described ball-circulating spindle 13*b* and is installed in a holding frame 12*b* for a grip device which is located on both sides of a movement part 12*a* which is guided using a feed guide 13*d* which moves forward and backward in the drawing. The edge area of the strip-like workpiece Wb is clamped from the bottom and top by a grip part Gr1 of a top component 12*c* and a grip part Gr2 of a bottom component 12*d*.

A guide shaft 12*e*, which is slidably installed in the holding frame 12*b*, is installed in the bottom component 12*d*. Furthermore, in the holding frame 12*b*, there is a first pneumatic piston 12*f* with a drive rod which has been installed in the bottom component 12*d*. When the first pneumatic piston 12*f* is being driven, therefore, the bottom component 12*d* is moved up.

The top component 12*c* is attached via a shaft 12*g* to the bottom component 12*d* and turns around the shaft 12*g*. On the side opposite the grip parts Gr1, Gr2 of the top component 12*c* and the bottom component 12*d* there is a spring 12*h* by which the top component 12*c* and the bottom component 12*d* are prestressed in a direction in which the grip parts Gr1 and Gr2 open.

In the bottom component 12*d*, there is a second pneumatic piston 12*i*, with a drive rod which penetrates the bottom component 12*d* and projects from it, and with a tip which borders the top component 12*c*. When the second pneumatic piston 12*i* is being driven, therefore the top component 12*c* turns around the shaft 12*g* and the grip parts Gr1 and Gr2 close.

On the other hand, the workpiece carrier WS is provided with vacuum suction openings O, as is shown in the drawings. When the strip-like workpiece Wb is exposed, a vacuum is applied by a vacuum part VP and the strip-like workpiece Wb is attached by suction through the vacuum suction openings O.

The strip-like workpiece Wb is clamped and is transported by the feed grip device 12 as follows:

Proceeding from the state which is shown in FIG. 9(*a*), the bottom component 12*d* is lifted by the first pneumatic piston 12*f*. As is shown in FIG. 9(*b*), the grip part Gr2 of the bottom component 12*d* comes into contact with the back of the strip-like workpiece Wb. The second pneumatic piston 12*i* is lifted. The grip part Gr1 of the top component 12*c* which clamps the strip-like workpiece Wb is lowered and clamps the strip-like workpiece Wb.

When the feed grip device 12 is holding the strip-like workpiece Wb, the ball-circulating spindle 13*b* of the feed grip drive part 13 turns and the feed grip device 12 moves downstream of the transport direction by a predetermined amount.

In this way, the strip-like workpiece Wb is transported by a set amount and the area of the strip-like workpiece Wb to be exposed next is transported to the exposure part 3.

During transport of the strip-like workpiece Wb, the workpiece carrier WS is removed underneath the transport plane. This prevents the back of the strip-like workpiece Wb from coming into contact with the workpiece carrier WS and being damaged. The danger of damage of the back of the strip-like workpiece Wb by contact with the workpiece carrier WS is furthermore prevented by air flowing out of the vacuum suction openings O of the workpiece carrier WS which are arranged for attachment of the strip-like workpiece (see FIG. 8) during transport of the strip-like workpiece Wb.

When the strip-like workpiece Wb has moved the predetermined amount and the area of the strip-like workpiece Wb to be exposed reaches the exposure part 3, movement of the strip-like workpiece Wb is stopped. The workpiece carrier WS which has been removed downward is lifted by a workpiece carrier drive part WSD (FIG. 6) as far as the transport plane. A vacuum is applied to the workpiece carrier WS by the above described vacuum part VP. The strip-like workpiece Wb is held stationary by vacuum suction on the surface of the workpiece carrier WS.

If, in doing so, the strip-like workpiece Wb remains clamped in the feed grip part 12, it is suctioned by the workpiece carrier WS in a state in which transport tensile force is applied to the strip-like workpiece Wb by the feed grip device 12. Also in the case in which the feed grip device 12 has released the hold of the strip-like workpiece Wb, the latter is suctioned by the workpiece carrier WS in a state in which it is subjected to the tensile force which forms between the takeoff reel 1 and the take-up reel 2.

When the strip-like workpiece Wb is attached to the workpiece carrier WS by suction, the second pneumatic piston 12*i* is pulled back. The top component 12*c* of the feed grip parts 12 turns, and the grip parts Gr1 and Gr2 release the strip-like workpiece Wb (state as shown in FIG. 9(*b*)). Furthermore, the first pneumatic piston 12*f* is pulled back and the bottom component 12*d* is lowered (state as shown in FIG. 9(*a*)). Then the feed grip part 12 is moved by the feed grip drive part 13 upstream of the transport direction and returns to the original position.

On the other hand, in the exposure part 3, a mask carrier drive part MSD moves a mask M, and positioning of the mask M to the workpiece and exposure are performed.

After completion of exposure, the two sides of the strip-like workpiece Wb are clamped by the feed grip parts 12. Furthermore, the vacuum attachment of the strip-like workpiece Wb is released by the workpiece carrier WS and the workpiece carrier WS is removed down. Next, the two edges of the strip-like workpiece Wb are held by the feed grip parts 12 which have been returned to the original position which is upstream of the transport direction, as was described above. The respective feed grip part 12 is moved downstream of the transport direction and the strip-like workpiece Wb is transported such that an area of the strip-like workpiece Wb which is to be exposed next reaches the exposure part 3.

(2) Serpentine Correction

When the strip-like workpiece Wb is being continuously transported, there are cases in which the strip-like workpiece Wb in the exposure part 3 in the direction of the width of the strip-like workpiece Wb (in the direction which is perpendicular to the feed direction of the strip-like workpiece Wb) has a position deviation. This must be corrected and the correct position of the strip-like workpiece Wb in the exposure part must be ensured. In doing so, a deviation of the strip-like workpiece Wb in the direction of the width is called the "serpentine" of the strip-like workpiece Wb. Correction of the serpentine of the strip-like workpiece Wb is called "serpentine correction."

In the above described case of a device in which the entire strip-like workpiece Wb is always subjected to a tensile force, the serpentine of the strip-like workpiece Wb is determined and corrected in the manner described below:

As is shown in FIG. 10, in the exposure part 3 at a stipulated position upstream of the workpiece transport direction there is an edge sensor S1 by which the edge position of the strip-like workpiece Wb is determined. The output of the edge sensor S1 is sent via a control member 31 to a takeoff reel drive device 32 and to an actuator 33. If during transport the edge sensor S1 determines a serpentine of the strip-like workpiece Wb, the control member 31, via the device 32 and by the actuator 33, moves the entire takeoff reel part 10 in the direction of the width of the strip-like workpiece Wb and corrects the serpentine.

An edge sensor as shown in FIG. 11(*a*) and (*b*) can be used as the edge sensor S1. As is shown in FIG. 11(*a*), an edge sensor can be used in which there are two pairs of photosensors S11 and S12 next to one another on the outside and inside of the strip-like workpiece Wb, the photosensor S11 being comprised of an emission element L11 and a light detection element PT1 and the photosensor S12 being comprised of an emission element L12 and a light detection element PT2.

Alternatively, a linear sensor S13 which is shown in FIG. 11(*b*) can be used which is composed of an emission element L13 and a line sensor LS1, such as a CCD or the like, which is located perpendicularly to the transport direction of the workpiece.

When using the sensor which is shown in FIG. 11(*a*), the edge position of the strip-like workpiece Wb is determined by a combination of ON and OFF of the photosensors S11 and S12. When using the sensor which is shown in FIG. 11(*b*), the edge position of the strip-like workpiece Wb is determined at a position at which the light is incident on the line sensor LS1.

As was described above, the workpiece in a conventional device in a state in which the strip-like workpiece Wb is exposed to a tensile force is held stationary by the workpiece carrier WS and exposed. If the strip-like workpiece Wb is, for example, a thin film of organic compound, the strip-like workpiece Wb is therefore exposed in a stretched state. When it is removed from the exposure device, the strip-like workpiece Wb is not exposed to a tensile force, by which the disadvantages arise that the strip-like workpiece Wb shrinks and the exposure accuracy changes.

When exposure is performed in a state as shown in FIG. 12(*a*) in which the tensile force is exerted and then the tensile force is removed, the strip-like workpiece Wb shrinks and the position of the exposure pattern deviates, as is shown in FIG. 12(*b*). In this way, the exposure accuracy can no longer be guaranteed.

Recently, the above described disadvantages were considered more and more often to be especially problematical due to the increase need for exposure accuracy, such as with miniaturization of the exposure pattern or the like.

SUMMARY OF THE INVENTION

The invention was devised to eliminate the above described disadvantages in the prior art. Therefore, the primary object of the present invention is, in an exposure device in which a strip-like workpiece is exposed to a tensile force and is transported by a grip feeding method, to hold stationary the strip-like workpiece without exposure to a tensile force by the workpiece carrier and to increase the exposure accuracy of the strip-like workpiece.

The object is achieved in accordance with the invention as follows:

In an exposure device which has a transport device for holding and for intermittent transport of a continuous workpiece with a great length and a control element which controls the above described transport device and transports a not yet exposed area of the workpiece in an intermittent manner to an exposure part, and in which the workpiece is transported with permanent exposure to a tensile force and is exposed in an exposure part, upstream of the exposure part, there is a first workpiece holding part for holding the workpiece, downstream of the exposure part there is a second workpiece holding part for holding the workpiece, and in the control element, a storage part which stores the amount in which the workpiece is returned upstream according to stretching as a result of the tensile force applied to the workpiece. The following takes place when the workpiece is exposed:

The control member holds the workpiece in the exposure part. After the workpiece has been attached by the first workpiece holding part, as a result of the amount of return motion stored in the storage part, the transport direction is returned in the direction to the exposure part. After a state is reached in which the workpiece is not exposed to a tensile force, the workpiece is attached by the second workpiece holding part.

As was described above, in accordance with the invention, upstream and downstream of the exposure part, there are a first holding part and a second holding part for holding the workpiece. Furthermore, according to the invention, in the control member, there is a storage part which stores the amount with which the workpiece is returned upstream according to the stretching as a result of the tensile force applied to the workpiece. After attaching the workpiece by the first workpiece holding part, as a result of the amount of return motion stored in the storage part, the transport device is returned in the direction to the transport direction. Since a state is achieved in which the workpiece is not exposed to a tensile force, the workpiece is attached by the second workpiece holding part and exposed. This measure in accordance with the invention prevents the workpiece from being exposed to a tensile force during exposure. Thus the exposure accuracy can be increased.

In the following the invention is further described using one embodiment shown in the drawings.

BRIEF DESCRIPTION OF THE DRAWINGS

FIGS. 4(*a*) to 4(*d*) each schematically show a step in the transport and exposure of the strip-like workpiece in the embodiment of the invention;

FIGS. 5(*e*) through 5(*g*) each show a further step in the transport and exposure of the strip-like workpiece in the embodiment of the invention;

FIGS. 9(*a*) through 9(*c*) each schematically show a step in the holding of the workpiece by the conventional feed grip part of FIG. 8;

DETAILED DESCRIPTION OF THE INVENTION

Figure 1:
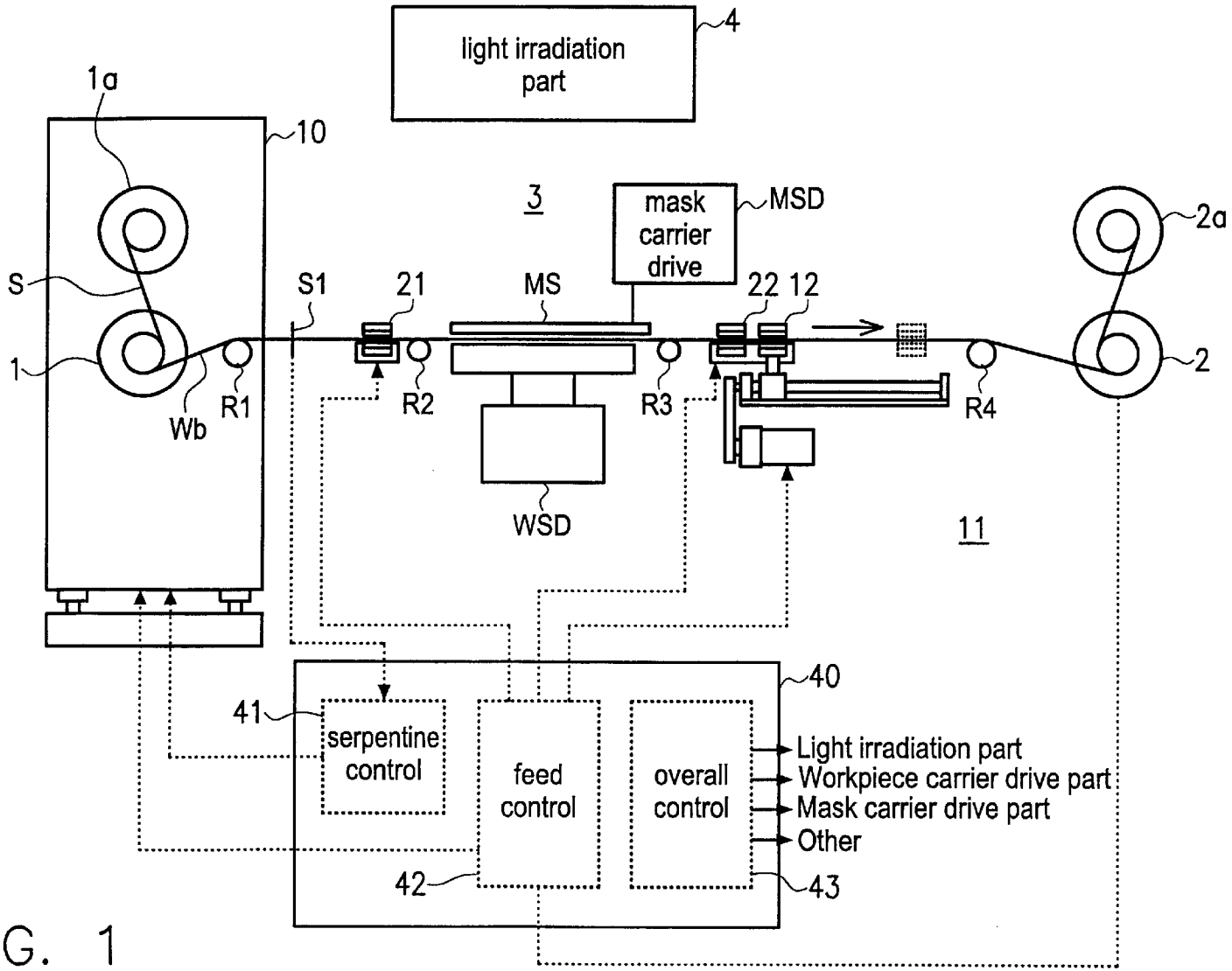
FIG. 1 is a schematic diagram of one embodiment of the invention.
Figure 6:
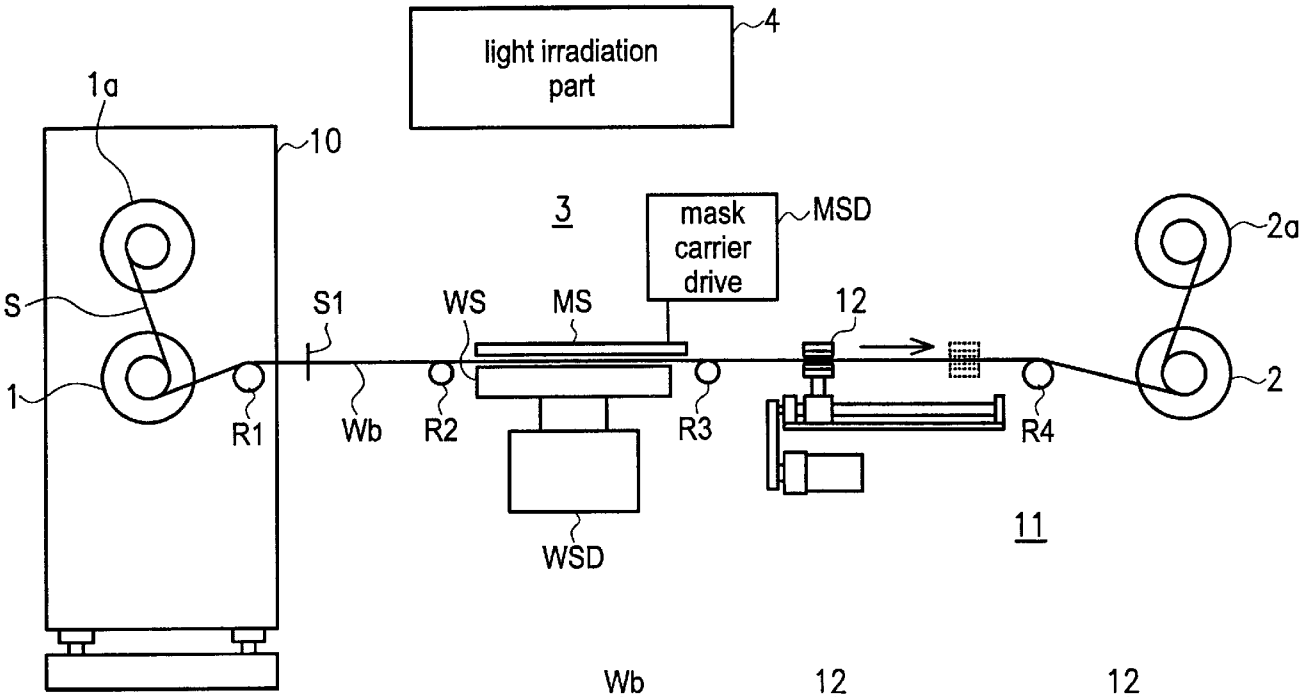
FIG. 6 (PRIOR ART)
FIG. 6 is a schematic diagram of a conventional example.

FIG. 1 is a schematic of the arrangement of one embodiment of the exposure device as in accordance with the invention for a strip-like workpiece. In the FIG. 1, the same parts as shown in FIG. 6 are provided with the same reference numbers. In this embodiment, in addition to the parts shown in FIG. 1, workpiece holding devices 21, 22 and a control member 40 are shown.

In the FIG. 1, a takeoff reel part 10 has a takeoff reel 1, a spacer take-up reel 1*a* and a guide roller R1 as was described above. The strip-like workpiece Wb is conventionally located on a spacer S and is wound in the manner of a roll around the takeoff reel 1. When the strip-like workpiece Wb is unrolled from the takeoff reel 1, the spacer S is wound up by the spacer take-up reel 1*a*.

To transport the strip-shaped workpiece Wb, the grip feeding method which is shown in FIGS. 6 to 9 is used. This means that downstream of the workpiece carrier WS there is a grip feeding device 11. The two sides of the strip-like workpiece Wb are held by the feed grip part 12 of the grip feeding device 11 and the strip-like workpiece Wb is transported, as was described above.

In this embodiment, a first workpiece holding device 21 and a second workpiece holding device 22 are located, respectively, upstream and downstream of the exposure part 3 of the exposure device in the transport direction of the strip-like workpiece Wb.

Figure 2:
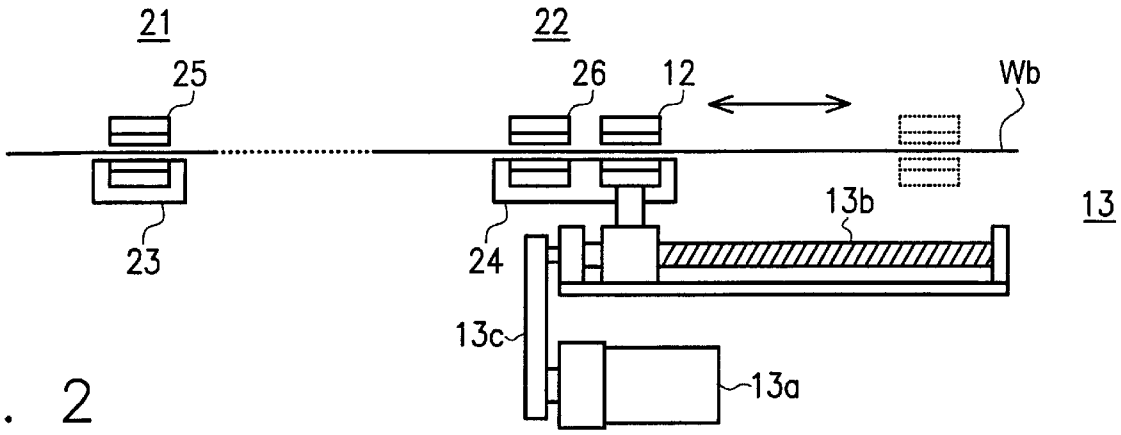
FIG. 2 schematically shows an enlarged view of the first and second workpiece holding device and the grip feeding device of FIG. 1.

FIG. 2 is an enlarged view of the workpiece transporting parts shown in FIG. 1. The first workpiece holding device 21 comprises a first suction holding carrier 23 and a first holding grip part 25, and the second workpiece holding device 22 similarly comprises a second suction holding carrier 24 and a second holding grip part 26. The first suction holding carrier 23 and the second suction holding carrier 24 apply a suction force to the back of the strip-like workpiece Wb by a vacuum, as is shown in the drawing. The first holding grip part 25 and the second holding grip part 26 clarnp the edge area of the strip-like workpiece Wb from the top and bottom and hold it securely.

The first suction holding carrier 23 and the second suction holding carrier 24 are located on the back of the strip-like workpiece Wb on the transport plane. They have the same arrangement as the workpiece carrier WS which is shown above in FIG. 8. Their surfaces are each provided with vacuum suction openings O for attachment of the strip-like workpiece Wb. When a vacuum is applied by vacuum part VP, the strip-like workpiece Wb is attached by suction to the suction holding carriers 23 and 24. When the strip-like workpiece Wb is being transported, air flows out of the vacuum suction openings O so that the back of the strip-like workpiece Wb is prevented from coming into contact with the surface of the first and second suction holding carriers 23 and 24.

Figure 7:
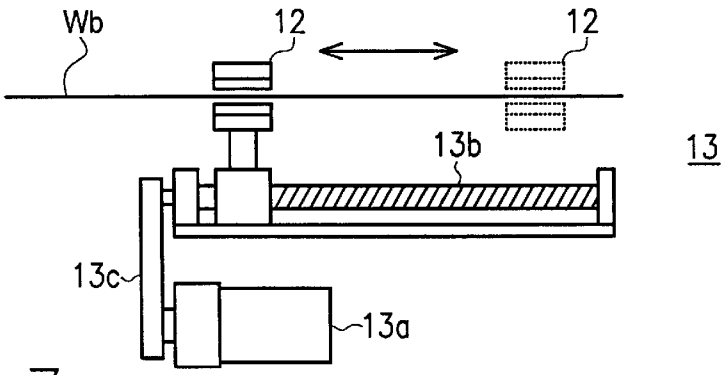
FIG. 7 (PRIOR ART)
FIG. 7 schematically shows an enlarged view of the first and second workpiece holding device and the conventional grip feeding device of FIG. 6.
Figure 8:
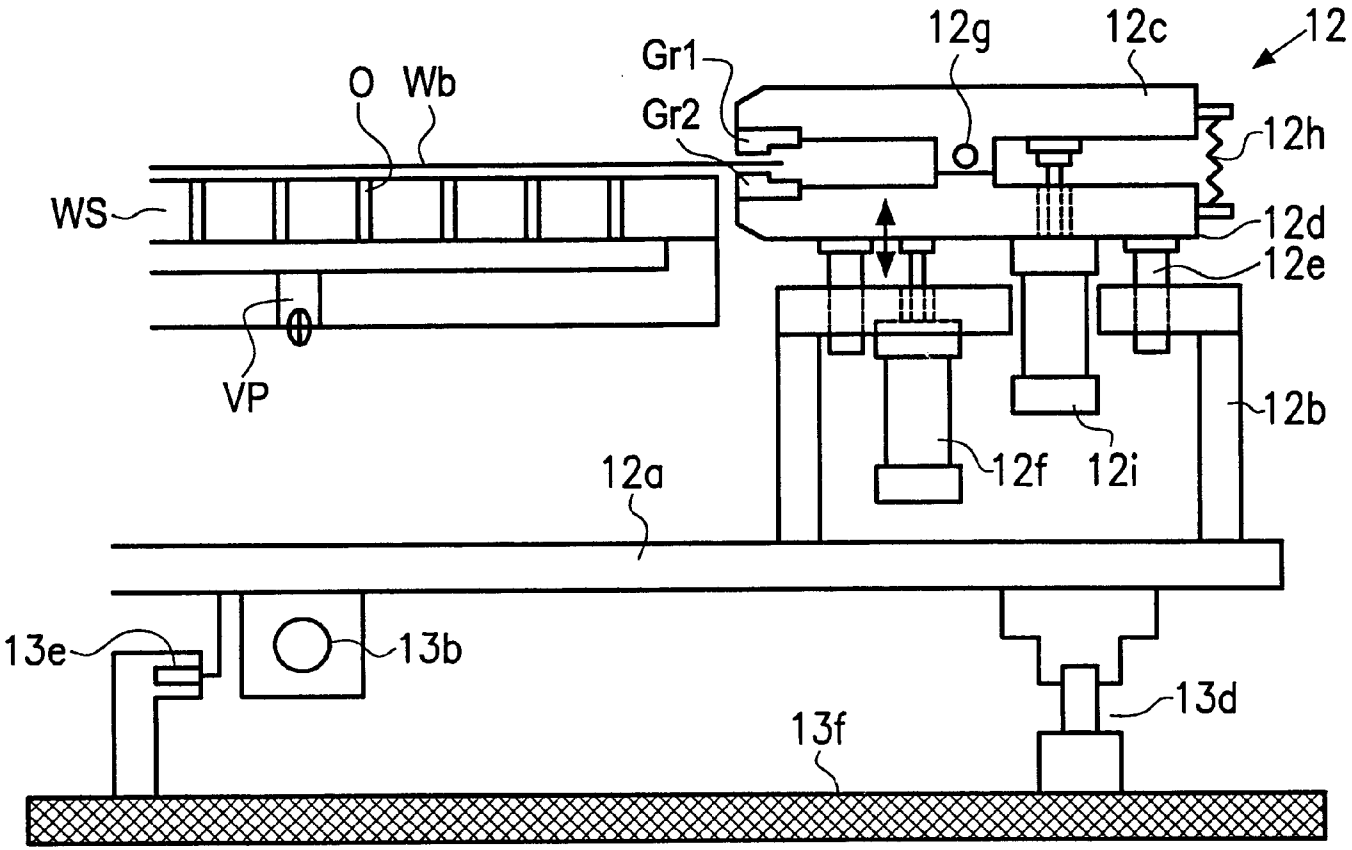
FIG. 8 (PRIOR ART)
FIG. 8 schematically depicts the arrangement of a specific example of the conventional grip feeding device.

The first holding grip part 25 and the second holding grip part 26 essentially have the same arrangement as the arrangement of the feed grip part which is shown in FIG. 8, described above. The first workpiece holding device 21 and the second workpiece holding device 22 are, however, not provided with the feed grip drive part which is shown in FIGS. 7 and 8 since the first holding grip part 25 and the second holding grip part 26 do not move in accordance with the present invention.

Figure 3:
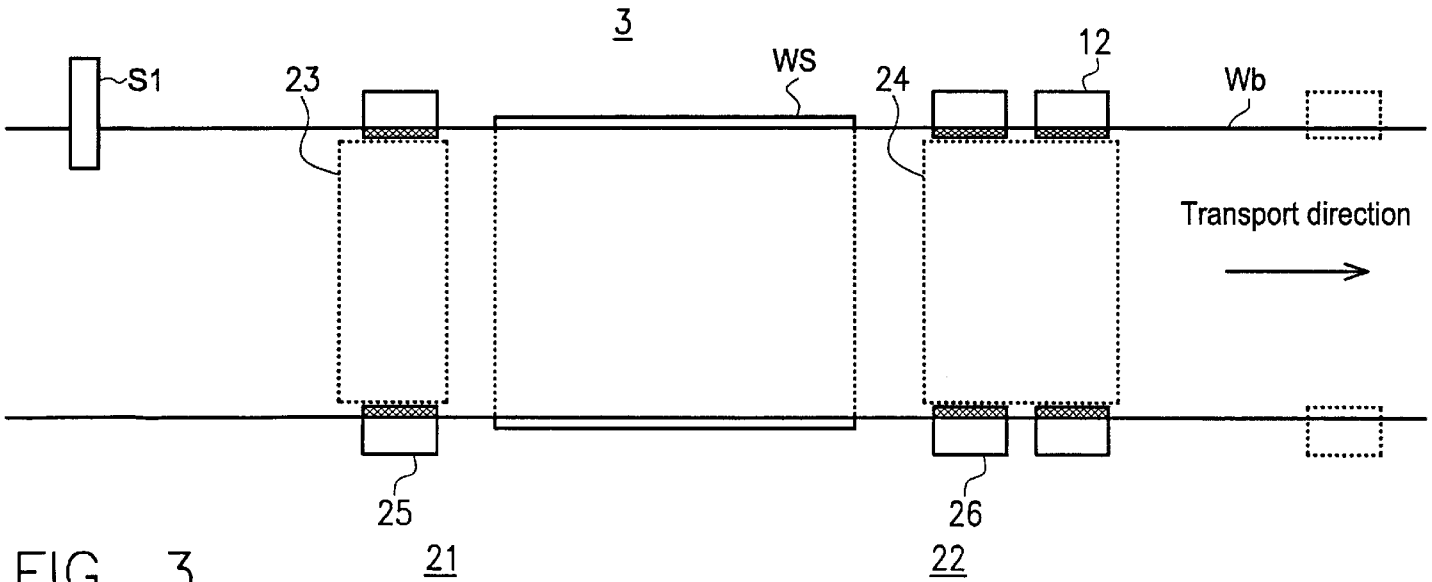
FIG. 3 a plan view of the first and the second workpiece holding device and the feed grip part of the grip feeding device of FIG. 1.

FIG. 3 is a plan view of the first and second workpiece holding device 21 and 22 and the feed grip part 12. As is shown in the drawings, the suction holding carrier 24 extends as far as the feed grip part 12.

The first holding grip part 25 and the second holding grip part 26 have the same arrangement as that of the feed grip part 12 which is shown in FIG. 7. In the case of the first and second holding grip parts 25 and 26, however, the ball-circulating spindle 13*b* and the moving part 12*a* are absent, but there are holding frames for attachment of the first and second holding grip parts 25 and 26 directly on the base. The processes of holding and releasing of the strip-like workpiece Wb by the first and second holding grip parts 25 and 26 are identical to the processes described above relative to FIG. 9.

Figure 10:
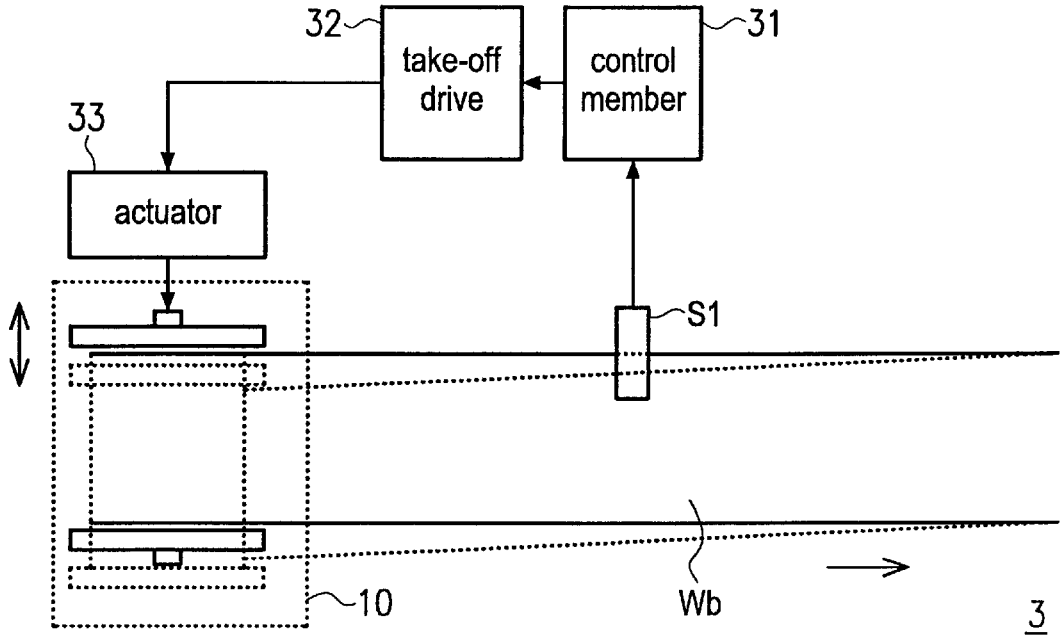
FIG. 10 shows a schematic of the serpentine correction.
Figure 11A:
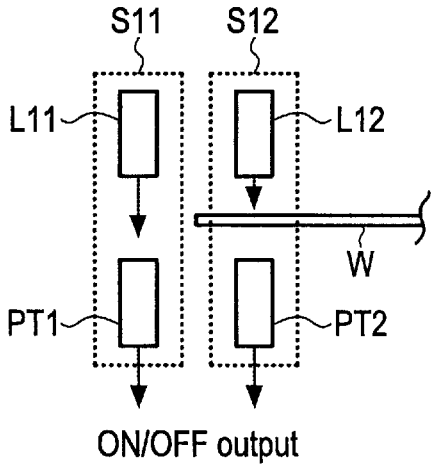
FIGS. 11(*a*) and 11(*b*), each show a schematic of an arrangement of an example of an edge sensor.
Figure 11B:
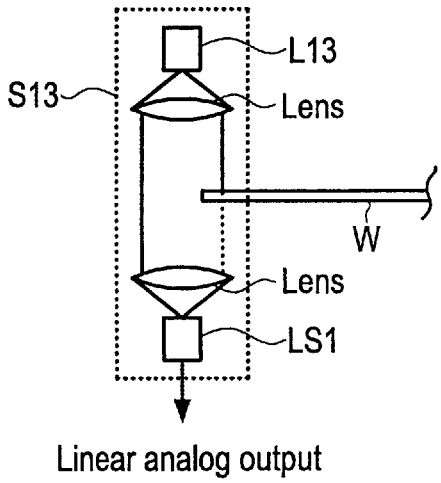
Figures 12A, 12B:
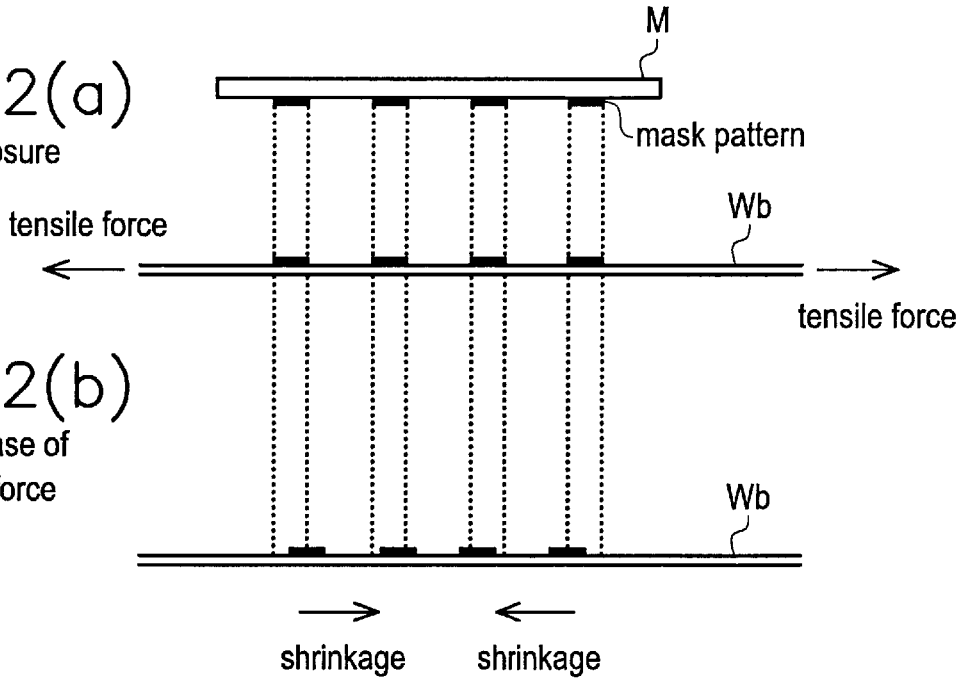
FIGS. 12(*a*) and 12(*b*) schematically represent the source of the reduction of the machining accuracy which is caused by shrinkage of the strip-like workpiece after exposure which occurs in prior art.

In FIG. 1, a control member 40 has a serpentine control member 41, a feed control member 42 and an overall control member 43. The serpentine control member 41, as was described above relative to FIG. 10, drives the takeoff reel part 10 by the output of the edge sensor S1 and executes serpentine correction of the strip-like workpiece. The feed control member 42 drives the takeoff reel 1, the take-up reel 2, the holding grip parts 25 and 26, and the feed grip part 12 and controls the transport of the strip-like workpiece Wb. The overall control element 43 controls a light irradiation part 4, a workpiece carrier drive part WSD, a mask carrier drive part MSD and the like, and furthermore, controls the entire sequence, such as transport, exposure and the like.

In the following, transport and exposure of the strip-like workpiece are described for this embodiment using FIGS. 4 and 5.

The control of takeoff and take-up of the strip-like workpiece Wb by means of the takeoff reel 1 and take-up reel 2 takes place in the same way as in the conventional example described in connection with FIG. 6. When the strip-like workpiece Wb is not being held by the workpiece holding devices 21 and 22, a tensile force is applied to it.

(1) At the time of completion of exposure of the strip-like workpiece Wb, the edge area of the workpiece Wb is clamped by the feed grip part 12, as is shown in FIG. 4 using the broken line. Both the holding grip part 25 of the holding device 21 and also the holding grip part 26 of the holding device 22 are open. The workpiece carrier WS is lowered to underneath the transport plane of the strip-like workpiece. A mask carrier MS shown in FIG. 1 is raised above the transport plane of the workpiece.

(2) The feed grip drive part 13 is driven and the feed grip part 12 is moved downstream of the transport direction. Since the strip-like workpiece Wb is clamped by the feed grip part 12, the workpiece Wb is transported according to the motion of the feed grip part 12.

(3) The danger of damage of the back surface of the strip-like workpiece Wb by contact of the back of the workpiece Wb with the surfaces of the workpiece carrier WS and the suction holding carriers 23 and 24 is prevented by the fact that, during the transport of the strip-like workpiece Wb, air flows out of the vacuum suction openings O of the workpiece carrier WS and the suction holding carriers 23 and 24 which are arranged to attach the workpiece, since the workpiece Wb is thus raised from the top sides of the workpiece carrier WS and the suction holding carriers 23 and 24.

(4) During transport of the strip-like workpiece Wb, the edge sensor S1 determines the edge position of the workpiece Wb. If a serpentine of the workpiece Wb is determined by this sensor S1, the signal of the edge sensor S1 is fed back and the entire takeoff reel part 10 is moved in the direction of the width of the workpiece Wb, as was described above using FIG. 10. In this way, serpentine correction is accomplished.

(5) When the feed grip drive part 13 has been moved downstream in the transport direction by a predetermined amount, it is stopped. Control of the amount of motion of the workpiece for transport of workpiece Wb as far as the next area to be exposed is produced by controlling the amount of motion of the feed grip drive part 13.

(6) After movement of the workpiece Wb has been stopped, the edge area of the workpiece Wb is clamped by the holding grip part 25 of the first workpiece holding device 21 which is located upstream of the exposure part 3. Furthermore, the back of the workpiece Wb is suctioned by vacuum applied by the suction holding carrier 23. In this way, attachment of the workpiece Wb is still ensured.

(7) In this state, the feed gripper part 12 is moved by the feed grip drive part 13 according to the amount of stretching of the workpiece Wb (100 to 200 microns) upstream in the transport direction by tensile force return transport, while the workpiece Wb remains clamped by the feed grip part 12, as is shown in FIG. 4. In this way, the tensile force which has formed in the workpiece Wb is eliminated.

(8) As is shown in FIG. 4(*c*), the edge area of the workpiece Wb is clamped by the holding grip part 26 of the second workpiece holding device 22 which is located downstream of the exposure part 3, Furthermore, the back of the workpiece Wb is suctioned by vacuum applied by the suction holding carrier 24. In this way, the attachment of the workpiece Wb is ensured even more.

(9) As is shown in FIG. 4(*d*), in the grip feeding device 11 the feed grip part 12 is released.

Furthermore, the vacuum suction device of the workpiece carrier WS is turned on. The workpiece carrier WS is raised by the workpiece carrier drive part WSD as far as the workpiece transport position. The workpiece Wb is suctioned and held by a vacuum on the workpiece carrier WS. This means that the workpiece Wb is fixed in a state in which is it not exposed to a tensile force on the workpiece carrier WS.

Even if the workpiece Wb is suctioned on the workpiece carrier WS, the first and second workpiece holding devices 21 and 22 are not released. The reason for this is that, when the devices 21 and 22 are released, the workpiece Wb, which was held in a state in which it would not be exposed to a tensile force, is still exposed to a tensile force because, between the takeoff reel 1 and the take-up reel 2, as before a tensile force is exerted which, however, cannot act on the workpiece when the holding devices 21, 22 are actuated.

(10) As is shown in FIG. 5(*e*) and 5(*f*), alignment and exposure are performed. During this, the feed grip part 12 returns to a preset position upstream of the transport direction (to the position shown in FIG. 5(*e*) using the solid line) and again clamps the workpiece Wb for the next transport of the workpiece Wb.

Alignment and exposure take place as follows:

First, as shown in FIG. 5(*e*), the mask carrier MS, which is shown in FIG. 1, is lowered by the mask carrier drive part MSD as far as the alignment position. Although the workpiece Wb is not exposed to a tensile force, it still has no deflection. Therefore, the workpiece carrier WS which secures the workpiece Wb cannot be raised to the workpiece transport plane. Furthermore, the positioning of the mask to the workpiece Wb cannot be done by moving the workpiece Wb.

Next, positioning of the mask M relative to the strip-like workpiece Wb is performed. Since the workpiece Wb cannot move, as was described above, positioning is performed by moving the mask carrier MS in the X-Y-θ direction (X-direction: for example, to the right and left in FIG. 5, Y-direction: to the front and back in FIG. 5, and θ-direction: in a direction of rotation around an axis perpendicular to the X-Y plane).

After completion of positioning, the mask carrier MS is moved to the exposure position, exposure light is emitted from the light irradiation part 4 (in FIG. 1) and exposure is produced.

(11) After completion of exposure, the mask carrier M is raised and moved in the X-Y-θ directions. Therefore, it is returned to the zero point position before movement.

(12) The vacuum attachment of the workpiece by the workpiece carrier WS is released. The workpiece carrier WS is lowered, as is shown in FIG. 5(*g*). The holding grip part 25 of the first workpiece holding device 21 and the holding grip part 26 of the second workpiece holding device 22 are released. Furthermore, vacuum suction of the first suction holding carrier 23 and the second suction holding carrier 24 is released.

(13) Since the strip-like workpiece Wb is clamped by the feed grip part 12 of the grip feeding device 11, the workpiece moves with the feed grip part 12, as was described relative to FIG. 4(*a*). The return transport, which has taken place as described above at (7) for reducing the tensile force, is corrected by the amount of reset. The feed grip part 12 therefore returns to the initial position which is shown in FIG. 4(*a*) and the tensile force originally acting on the workpiece is re-established. Afterwards, the workpiece Wb is transported as far as the next exposure position, and the above described processes (1) to (13) are repeated.

ACTION OF THE INVENTION

As was described above, in accordance with the invention the following effects can be obtained:

(1) The workpiece is not subjected to a tensile force during exposure by the measure that upstream of the exposure part there is a first workpiece holding part and downstream of the exposure part there is a second workpiece holding part, that furthermore, after transport of the strip-like workpiece in the first workpiece holding part, the workpiece is attached and afterwards the workpiece is moved back upstream in accordance with the the amount of stretching, and that afterwards the workpiece is attached by the second workpiece holding part and is held on the workpiece carrier. This prevents exposure in a stretched state of the workpiece and the reduction of exposure accuracy.

(2) Since the strip-like workpiece is exposed to a tensile force, shortly before it is suctioned and held by the workpiece carrier, the workpiece can be suctioned and held by the workpiece carrier without waviness and folds being formed in the workpiece. This can prevent the exposure accuracy of the strip-like workpiece from being reduced as a result of folds, waviness and the like.

What we claim is:

1. Exposure device for a strip-shaped workpiece of indefinite length, comprising:

an exposure part a transport device for holding and for intermittent transporting of a strip-shaped workpiece to and from the exposure part, the transport device being movable in a downstream direction and in an upstream direction; and a control element which controls the transport device such that an unexposed area of the workpiece is transported in an intermittent manner in said downstream direction to the exposure part where it is exposed;

wherein the transport device comprises a first workpiece holding part located upstream of the exposure part for holding the workpiece and a second workpiece holding part located downstream of the exposure part for holding the workpiece; and wherein the control element comprises a storage part which stores an pullback amount which a tensile-stressed, unexposed part of the workpiece is to be moved back in said upstream direction by said transport device to result in there being essentially no tensile stress on the part of the workpiece to be exposed.

2. Exposure device as claimed in claim 1, wherein the control element is adapted to issue said amount of pull-back stored in the storage part as a control command to the transport device, after the workpiece has been transported by the transport device to the exposure part and has been attached to the first workpiece holding part, by which the transport device is moved in said upstream direction relative to the exposure part as far as a position in which results in essentially no tensile force acting on a part of the workpiece to be exposed.

3. Exposure device as claimed in claim 2, wherein the control element is adapted to issue a second control command to the transport device, by which the workpiece is fixed by the second workpiece holding part subsequent to said upstream movement of the transport device.

* * * * *